US006599169B2

(12) United States Patent
Edmisson et al.

(10) Patent No.: US 6,599,169 B2
(45) Date of Patent: Jul. 29, 2003

(54) TOY VEHICLE ADJUSTABLE SUSPENSION SYSTEM

(75) Inventors: Russell Curtis Edmisson, Westport, CT (US); Peter Henry Asher, Escondido, CA (US)

(73) Assignee: XConcepts, LLC, Escondido, CA (US)

( * ) Notice: Subject to any disclaimer, the term of this patent is extended or adjusted under 35 U.S.C. 154(b) by 0 days.

(21) Appl. No.: 10/174,228

(22) Filed: Jun. 17, 2002

(65) Prior Publication Data

US 2003/0003843 A1 Jan. 2, 2003

Related U.S. Application Data

(60) Provisional application No. 60/299,359, filed on Jun. 19, 2001.

(51) Int. Cl.[7] ..... A63H 17/26
(52) U.S. Cl. ..... 446/466; 446/469
(58) Field of Search ..... 446/431, 437, 446/448, 405, 466, 469; 280/124.145, 124.179, 124.102

(56) References Cited

U.S. PATENT DOCUMENTS 1,563,547 A 12/1925 Bovee
2,346,319 A 4/1944 Mitchell
2,531,933 A * 11/1950 Clark ..... 267/289
3,039,788 A 6/1962 Fargo
4,696,655 A 9/1987 D'Andrade
5,265,902 A * 11/1993 Lewis ..... 280/124.102
5,306,038 A 4/1994 Henderson
5,322,469 A 6/1994 Tilbor
5,334,077 A 8/1994 Bailey
5,338,246 A 8/1994 Suto
5,785,576 A 7/1998 Belton

* cited by examiner

*Primary Examiner*—Derris H. Banks
*Assistant Examiner*—Bena B. Miller
(74) *Attorney, Agent, or Firm*—Kenneth R. Wright

(57) ABSTRACT

The present invention relates to a suspension system for a toy vehicle. The suspension system is independent in that it comprises at least four damping mechanisms (shock absorber), each shock absorber being located proximal to each wheel location. Each shock absorber utilizes a tensioning device, such as a compressed spring, positioned between the toy vehicle chassis and a suspension arm, to provide the active damping feature of the invention. Each shock absorber also utilizes an adjustment means, such as a screw, to selectively change the distance between the suspension arm and chassis. As the screw is adjusted, so the spring is either more or less compressed, providing for a stiffer (more compressed) or a softer (less compressed) suspension. Furthermore, adjusting the screw to compress the spring causes the body of the toy vehicle to be lowered relative to the suspension arm/wheel assembly, and adjustment of the spring to decrease the spring compression causes the body of the toy vehicle to be raised relative to the suspension arm/wheel assembly.

5 Claims, 5 Drawing Sheets

TOY VEHICLE ADJUSTABLE SUSPENSION SYSTEM

This applicaton claims the benefit of Provisional application No. 60/299,359 filed Jun. 19, 2001.

TECHNICAL FIELD

The present invention is directed to the field of scale model toy vehicles. More particularly, the present invention relates to an adjustable suspension system that provides 1) an active damping mechanism (also referred to herein as shocks or shock absorbers) and 2) an adjustment to the shocks which changes the damping and sets the height of the toy vehicle body relative to the axis of the wheel/suspension arm units.

BACKGROUND OF THE INVENTION

Known suspension systems for toy vehicles that utilize springs have generally been of the damping variety only. That is, the body of the vehicle will move relative to the axis of the wheel/suspension arm units, but the body ultimately returns to it's original position. Therefore, known toy vehicle suspension systems using springs lack the ability to change the height of the body relative to the axis of the wheel/suspension arm units on a semi permanent basis. With the popularity of customizing full-size vehicles by changing the body height relative to the axis of the wheel/suspension arm units with the appropriate change in the behavior of the suspension (for example, lowering the body in the case of "low riders" with their harder suspension and raising the body in the case of "high-rise trucks" with their softer suspension), the need has been identified for a toy vehicle that can replicate these custom features.

BRIEF SUMMARY OF THE INVENTION

The object of the present invention is to provide an active damping suspension system for a toy vehicle that includes the ability to set the height of the body relative to the axis of the wheel/suspension arm units on a semi permanent basis. The toy vehicle body may be adjusted higher relative to the axis of the wheel/suspension arm units or lower, depending on the customized "look" that the user desires. The present invention provides for a manual shock setting using a mechanism that combines a spring, and an adjustment element, such as a screw, at each wheel location, such that the toy vehicle body-wheel axis distance can be adjusted up or down via the adjustment element, and that such adjustments can be repeatedly made. These adjustments also soften or harden the suspension depending on whether the adjustment is made to raise or lower the vehicle body. The present invention may be further understood by consideration of the following drawings and associated description.

DETAILED DESCRIPTION OF THE INVENTION

Figure 2:
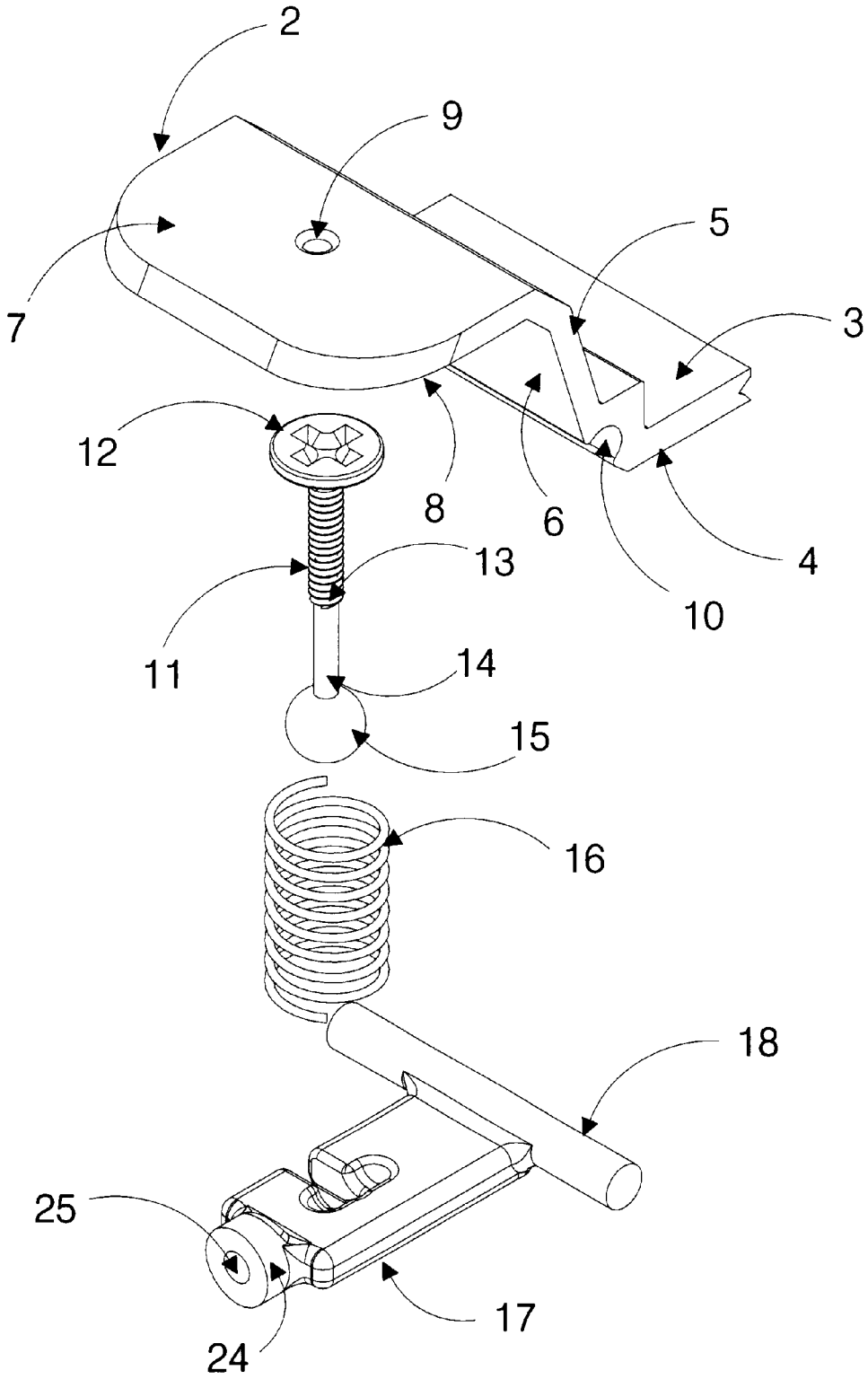
FIG. 2 is an exploded view of the toy vehicle adjustable suspension system, illustrating the preferred embodiment of the invention.

Referring to FIG. 2 of the drawings, the toy vehicle adjustable suspension system shown may be used on any of various toy vehicles such as a passenger car, pick-up truck, sports utility vehicle, stock car, racing car, and the like.

Figure 1:
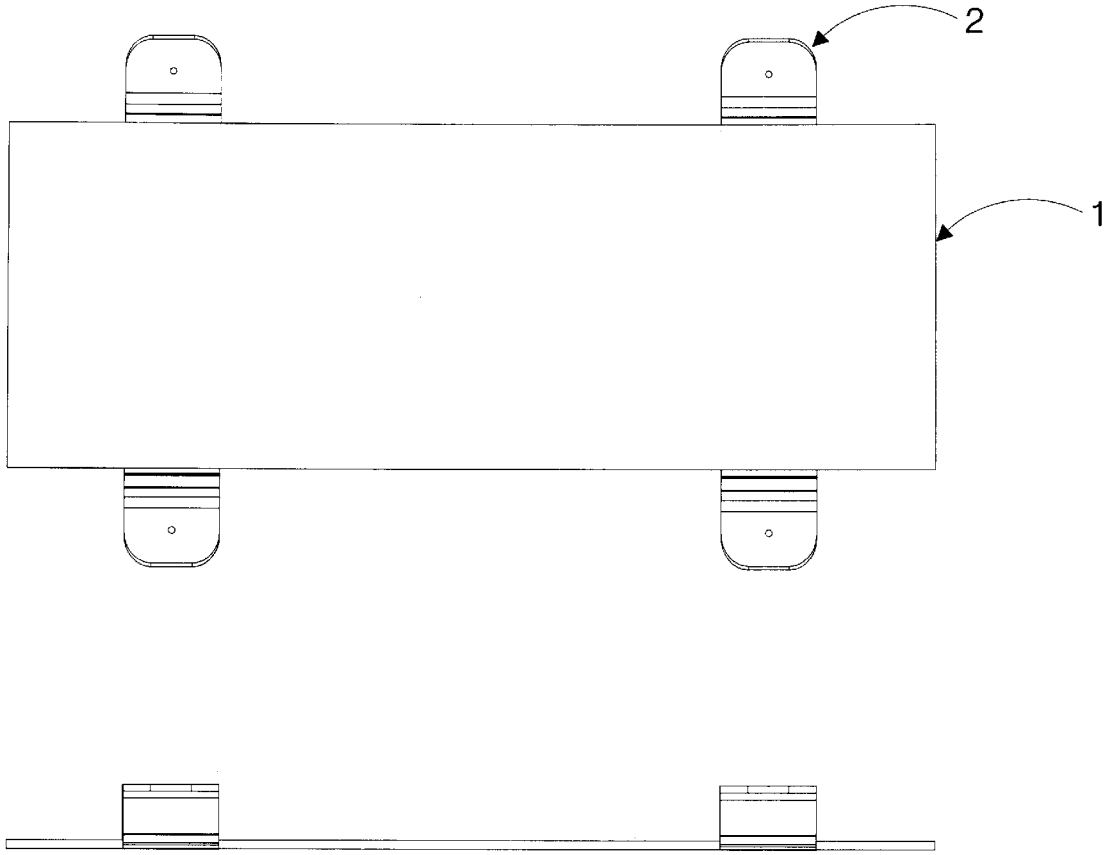
FIG. 1 is a plan and side elevation of the vehicle chassis.

In it's preferred embodiment, the vehicle chassis 1 in FIG. 1 has a generally rectangular configuration. The chassis 1 has at least four suspension arm support means, also referred to as chassis tabs 2. Each chassis tab 2 is located on the chassis 1 to align with the axial plane of each wheel assembly (shown with hidden line detail in FIG. 1).

Referring to FIG. 2, 3, and/or 4, the chassis tab 2 has an upper horizontal plane, which has an upper surface 3 and a lower surface 4; an angular plane, which has an upper surface 5 and a lower surface 6; and a lower horizontal plane, which has an upper surface 7 and a lower surface 8. The chassis tab lower horizontal plane has a radial inner wall 9 located at approximately it's center. The radial inner wall 9 has means for retaining the adjustment element 11. In this preferred embodiment, 9 is a threaded hole (also referred to as "threaded retainer"). The chassis tab 2 also has a means for attaching the suspension arm 17 while permitting lateral and longitudinal adjustment of the suspension arm 17. In our preferred embodiment this attachment is achieved using a cylindrical groove 10 located at the intersection of the first horizontal plane lower surface 4 and angular plane lower surface 6. The profile of the cylindrical groove 10 is in the range of 180–300 degrees, the purpose of which will become clear in the description of the method of assembly, below.

Referring to FIGS. 2 and/or 4, in it's preferred embodiment, the adjustment element 11, is a circular shaft that has longitudinal axis and at its upper end a means for rotationally turning the adjustment element 12 about its longitudinal axis (as illustrated in FIG. 2, rotation is provided for by a first flange 12 shaped to accept a cross-head style screwdriver, but it could also be a thumb-screw type, or the like). Proximal to its upper end, the adjustment element 11 has a threaded shaft 13, to match the threaded radial inner wall of the chassis tab second horizontal plane 9. The threaded shaft 13 has a diameter greater than the means for retention element 15. Below the threaded section of the shaft 13, the shaft 14 has a diameter less than the means for retention element 15. At the adjustment element lower end is a means for retention element 15.

The tension element 16, in our preferred embodiment is a spring-type element as shown in FIGS. 2 and/or 4, which has an inner diameter that is greater than the outer diameter of both the adjustment element retention element 15 and threaded shaft 13.

Figure 3:
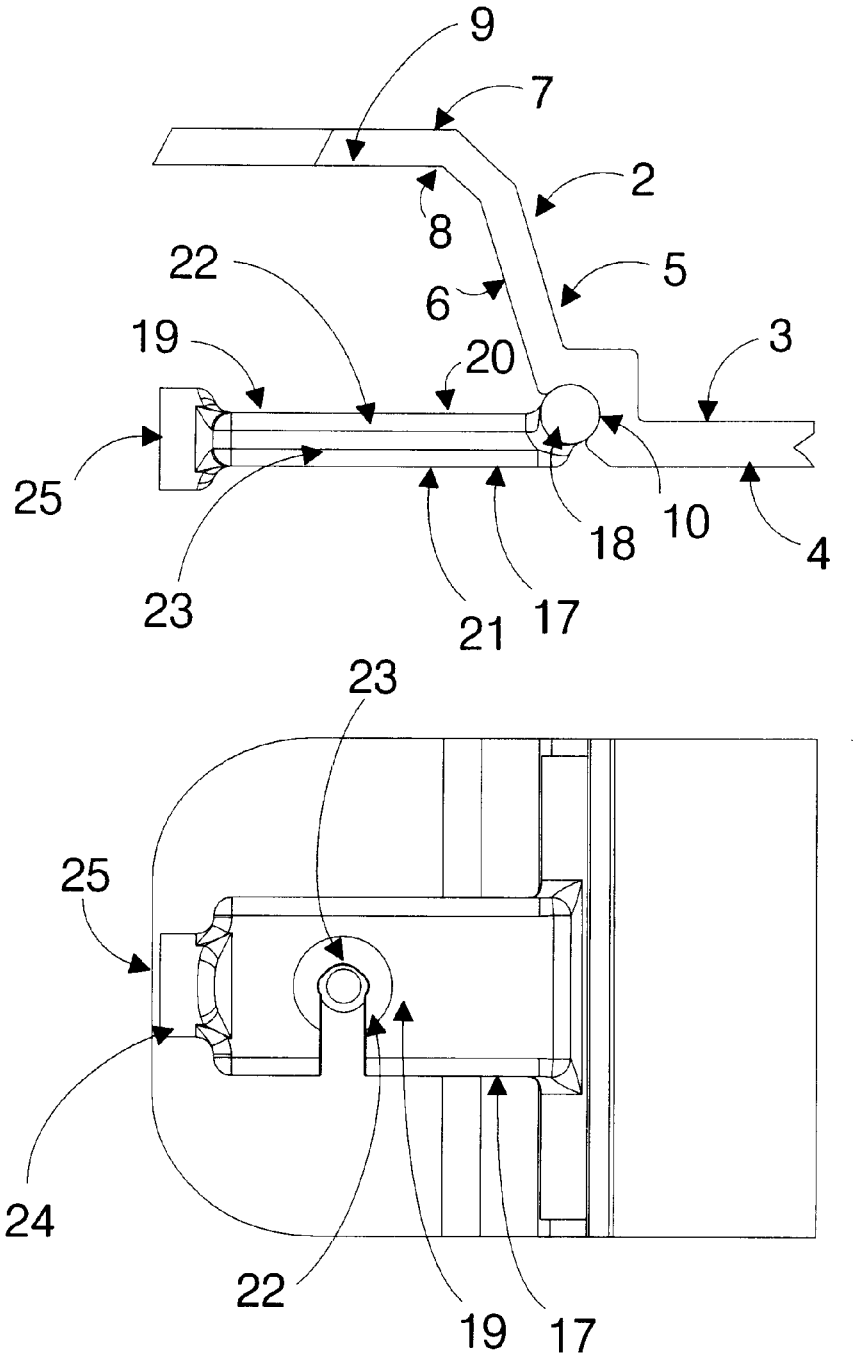
FIG. 3 is a bottom view and side sectional view of the vehicle pan and suspension arm assembly.
Figure 4:
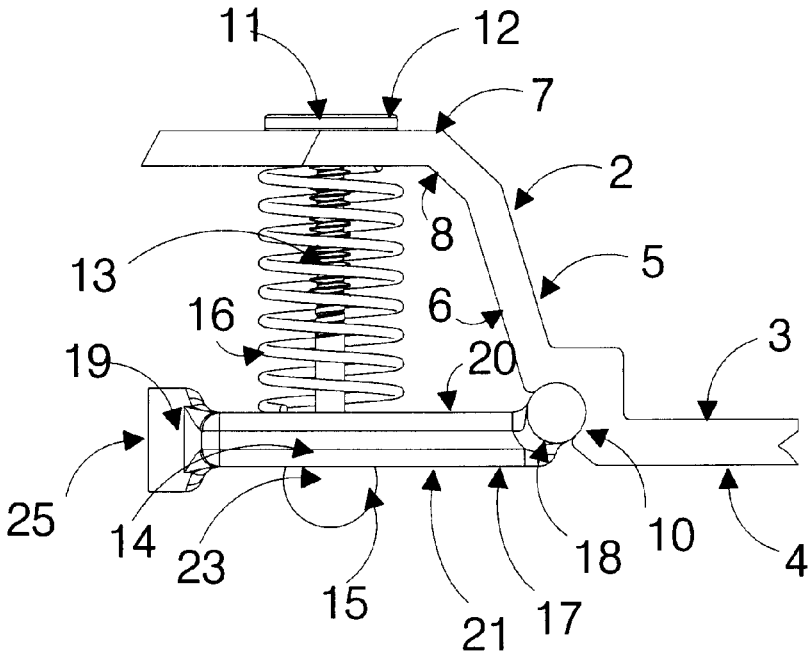
FIG. 4 is a top view and side sectional view of the toy vehicle adjustable suspension system assembly.
Figure 4:
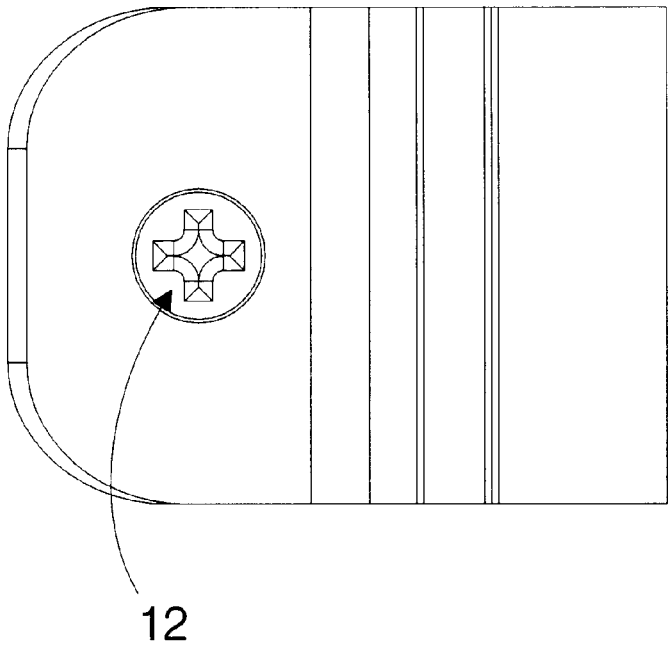

The suspension arm 17 is illustrated in FIGS. 2, 3 and 4. The suspension arm 17 first end has a means for connecting it to the chassis tab 2, which in it's preferred embodiment, is a circular shaft section 18 that is sized to provide a friction or slide fit with the chassis tab cylindrical groove 10. By attaching each suspension arm via its circular shaft section 18 to the cylindrical groove 10 of each chassis tab, a hinged connection between these components is achieved, allowing vertical movement of the suspension arm. The suspension arm 17 also has a rectangular section 19 which has an upper face 20, and a lower face 21. Referring to FIG. 3, the suspension arm rectangular section 19 has a means for retaining the adjustment element 11 (also referred to as "slotted socket retainer"), which provides axial alignment and allows rotational movement of the adjustment element while allowing the adjustment element 11 to perform it's adjustment function. In our preferred embodiment, the suspension arm rectangular section 19 has a cut-out 22 with an oversized end-radius 23. The cut-out 22 is shaped to permit the shaft of the adjustment element 14 to be inserted into the cut-out 22, and to provide means for retention of the retention element 15 via the oversized end-radius 23, and allow for the slight lateral movement of the adjustment element 11 that occurs when the adjustment element 11 is adjusted. The preferred embodiment for the means for retention of the adjustment element is illustrated in FIG. 2 and 4, showing a ball-socket arrangement as between the retention element 15 (ball) and oversized end-radius 23 (socket).

Figure 5:
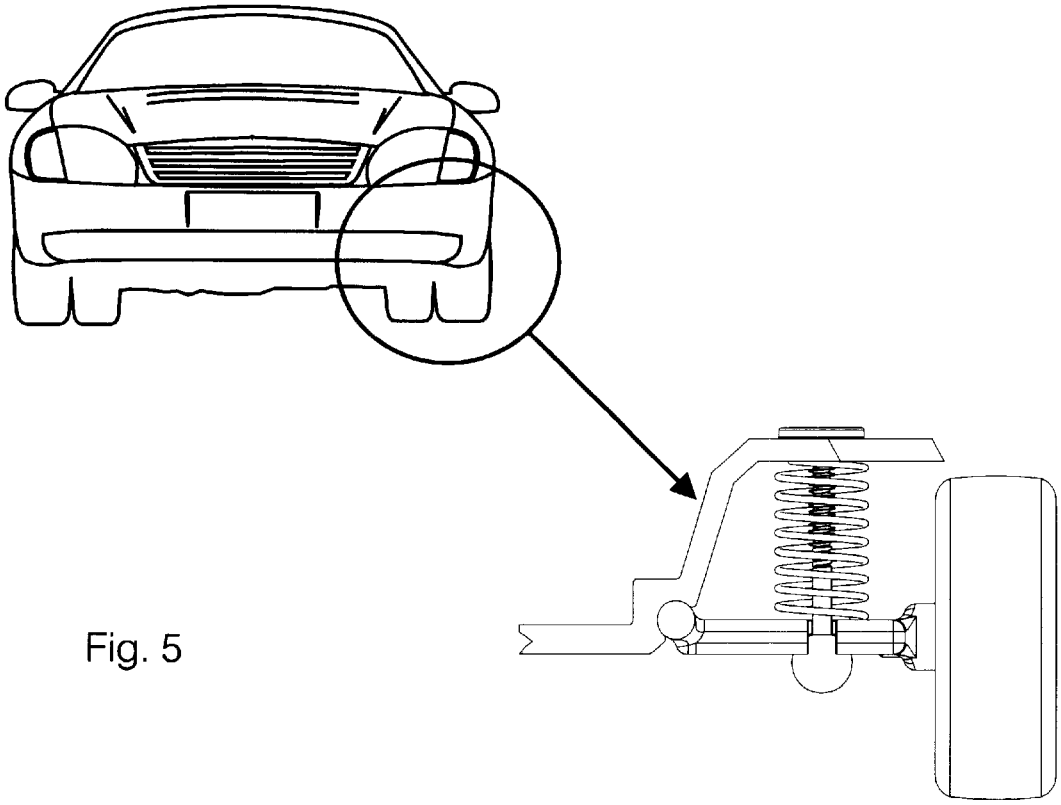
FIG. 5 is a blow-up of a cut-away view of the toy vehicle showing the adjustable suspension system as it relates to the vehicle chassis and wheel.

Referring to FIGS. 2 and 3, in our preferred embodiment, the suspension arm 7 has a second end section 24 at the end of the rectangular section 19, which has an internally threaded bore 25 to provide means for attaching the suspension system assembly of the present invention to the wheel assembly (see FIG. 5 for the relationship between suspension system and wheel assembly).

The foregoing describes the components that combine to form the preferred embodiment of the present invention, which may be assembled as follows:

The adjustment element 11 is inserted into the threaded retainer 9 from the top, adjustment element retention element 15 first. The adjustment element retention element 15 and the shaft section 14, pass through the radial inner wall 9. The adjustment element is then rotated so that the threaded shaft 13 screws into the radial inner wall 9 until the adjustment element first flange 12 contacts the chassis tab second horizontal plane upper surface. The tension element 16 is then placed over the portion of the adjustment element that extends from the chassis tab second horizontal plane lower surface 8.

The suspension arm 17 is attached to the chassis tab 2 by connecting the circular shaft section 18 of the suspension arm to the cylindrical groove 10 of the chassis tab. The suspension arm 17 is then manually positioned so that the adjustment element shaft section 14 is inserted into the suspension arm rectangular section cut-out 22 and moved toward the countersunk radial inner wall 23. This configuration maintains the axial alignment of the adjustment element while allowing for rotation of the adjustment element, and for longitudinal alignment of the suspension arm 17.

As assembled, the tension element 16 creates a tensional force between the suspension rectangular section upper face 20 and chassis tab second horizontal plane lower surface 8. This permits the tension element to act as a shock absorber. The relative tension of the tension element (or damping of the shock absorber) can be adjusted by turning the adjustment element 11 to compress the tension element 16, which creates a stiffer shock and lowers the toy vehicle body, relative to the wheel/axle assembly. This adjustment is used to give the toy vehicle the stiffer suspension and lowered body appearance of a "low-rider." By turning the tension element 11 in the opposite direction to reduce the tension of the tension element 16, the shock becomes less stiff and increases the height of the toy vehicle body relative to the to the wheel/axle assembly. This adjustment is used to give the toy vehicle the increased body height appearance of a "high-rise truck".

Various modifications can be made without departing from the broader scope of the present invention. The purpose of the present invention is to allow the suspension of a toy vehicle to be adjusted on a semi-permanent basis so that the body can be raised/lowered and the shock stiffness can be increased/decreased: It should be recognized that the present invention can be achieved in a number of ways, including but not limited to adjustment of the suspension from the underside of the toy vehicle, and that this invention is intended to cover such other ways within the scope and spirit of the invention, as defined by the appended claims.

What is claimed is:

1. A toy vehicle adjustable suspension system, comprising:

(a) a chassis including at least four suspension arm support means for attaching to said chassis, said suspension arm support means each having an upper and lower horizontal plane, said upper horizontal plane also having a threaded retainer;

(b) at least four suspension arms each having a first and second end separated by a rectangular section, wherein said first end is hingedly connected to said lower horizontal plane to permit vertical movement of said suspension arm, said second end has means for attaching a wheel assembly, and said rectangular section has a slotted socket retainer;

(c) at least four adjustment elements each having a longitudinal axis and an upper and lower end, wherein said upper end has means for rotating said adjustment element about said axis and said upper end is retained by said threaded retainer so as to permit said adjustment element to move up or down relative to said upper horizontal plane, when rotated in one direction or the other, and said lower end has means for retention by said slotted socket retainer; and (d) at least four tension elements each positioned between said upper horizontal plane and said suspension arm so as to permit a force against the lower surface of said upper horizontal plane and upper surface of said suspension arm.

2. The toy vehicle adjustable suspension system of claim 1, wherein said tension element is a spring.

3. The toy vehicle adjustable suspension system of claim 2, wherein said means for rotating said adjustment element can be operated by a cross-head style screwdriver.

4. The toy vehicle adjustable suspension system of claim 3, wherein said suspension arm second end means for engaging a wheel assembly is an internally threaded bore.

5. The toy vehicle adjustable suspension system of claim 4, wherein said adjustment element lower end means for retention by said slotted socket retainer form a ball and socket-type configuration.

* * * * *